US007637634B2

(12) United States Patent
Chu

(10) Patent No.: US 7,637,634 B2
(45) Date of Patent: Dec. 29, 2009

(54) LIGHT SOURCE MODULE

(75) Inventor: Yuan-Fa Chu, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 67 days.

(21) Appl. No.: 11/940,884

(22) Filed: Nov. 15, 2007

(65) Prior Publication Data

US 2008/0298069 A1 Dec. 4, 2008

(30) Foreign Application Priority Data

Jun. 1, 2007 (CN) ..... 2007 1 0074695

(51) Int. Cl.
*F21V 29/00* (2006.01)

(52) U.S. Cl. ..... 362/294; 362/373

(58) Field of Classification Search ..... 362/800, 362/294, 373
See application file for complete search history.

(56) References Cited

U.S. PATENT DOCUMENTS

| | | | | |
|---|---|---|---|---|
| 7,325,955 | B2 * | 2/2008 | Lucas et al. | 362/545 |
| 7,338,186 | B1 * | 3/2008 | Wu et al. | 362/294 |
| 7,344,296 | B2 * | 3/2008 | Matsui et al. | 362/652 |
| 7,355,113 | B2 * | 4/2008 | Itoigawa et al. | 136/205 |
| 2009/0016232 | A1 * | 1/2009 | Kwon et al. | 370/252 |

* cited by examiner

*Primary Examiner*—Anabel M Ton
(74) *Attorney, Agent, or Firm*—Clifford O. Chi

(57) ABSTRACT

A light source module includes a plurality of light emitting diodes (21), a heat dissipation device (27) and a thermoelectric cooler (24) having a cold side (241) and a hot side (242). The light emitting diodes thermally contact with the cold side of the thermoelectric cooler. The heat dissipation device thermally contacts with the hot side of the thermoelectric cooler.

10 Claims, 5 Drawing Sheets

LIGHT SOURCE MODULE

BACKGROUND OF THE INVENTION

1. Field of the Invention

The present invention relates to a light source module, and particularly to a light source module having a thermoelectric cooler which can enhance heat dissipation efficiency of the light source module.

2. Description of Related Art

Light emitting diode (LED) is a PN junction diode formed by an epitaxial P-type layer and an epitaxial N-type layer on a heavily doped semiconductor compound base. Visible light emitting diode used as light source has merits of high luminiferous efficiency, small volume and long life span. Therefore, light source modules that made of light emitting diodes are widely used in many fields such as street lamps.

A light source module, shown in FIG. 5, generally includes a plurality of LEDs 11, a printed circuit board (PCB) 12, and a heat dissipation device 13. The heat dissipation device 13 includes a base 131 and a fin unit 132 extending upwardly from the base 131. The LEDs 11 are mounted on one side of the printed circuit board 12, and the base 131 thermally contacts with an opposite side of the printed circuit board 12 to the LEDs 11. As the LEDs 11 heats up during illumination, heat is transferred in a form of heat flux from the LEDs 11 with higher temperature to the fin unit 132 with lower temperature. The printed circuit board 12 with the LEDs 11 mounted thereon is coupled on the base 131 of the heat dissipation device 13 tightly so as to reduce the transferred distance of heat flux. Thus, the heat dissipation efficiency of the heat dissipation device can be improved. However, with the limitation of the configuration and function of the light source module, reducing the transferred distance of heat flux is increasingly difficult. Therefore, the possibility of improving heat dissipation efficiency of the light source module is limited.

What is needed, therefore, is an improved light source module which can overcome the above problems.

SUMMARY OF THE INVENTION

A light source module includes a plurality of light emitting diodes, a heat dissipation device and a thermoelectric cooler having a cold side and a hot side. The cold side of the thermoelectric cooler thermally contacts with the light emitting diodes, and the hot side of the thermoelectric cooler thermally contacts with the heat dissipation device.

Other advantages and novel features of the present light source module will become more apparent from the following detailed description when taken in conjunction with the accompanying drawings, in which:

BRIEF DESCRIPTION OF THE DRAWINGS

Many aspects of the present light source module can be better understood with reference to the following drawings. The components in the drawings are not necessarily drawn to scale, the emphasis instead being placed upon clearly illustrating the principles of the present light source module. Moreover, in the drawings, like reference numerals designate corresponding parts throughout the several views.

DETAILED DESCRIPTION OF THE INVENTION

Figure 1:
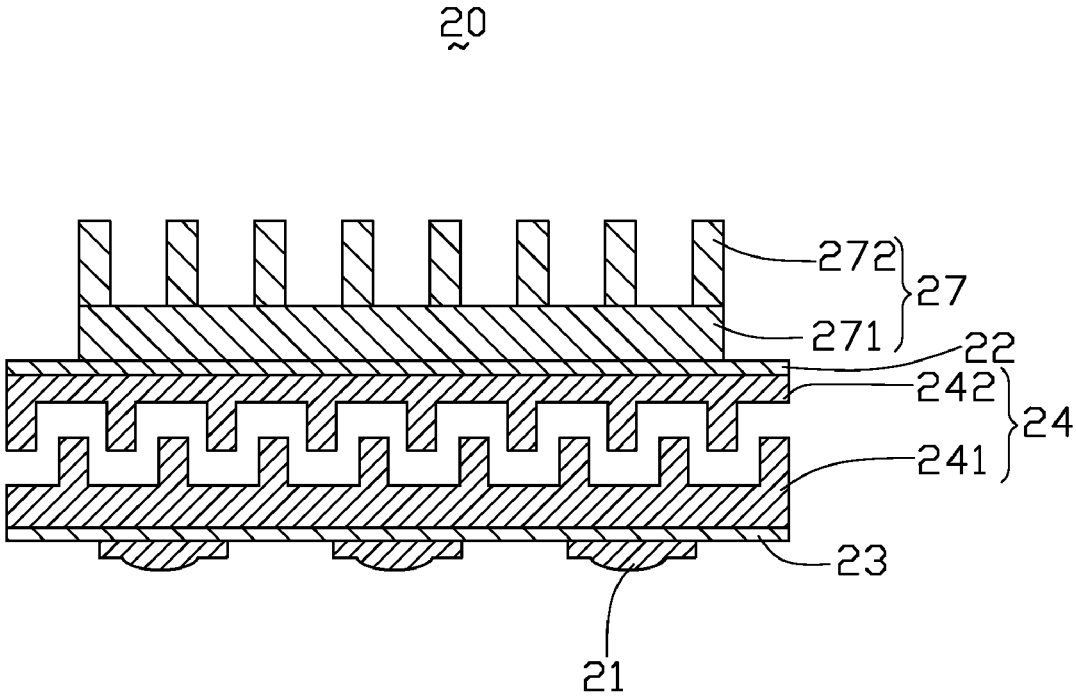
FIG. 1 is a cross-sectional view of a light source module, in accordance with a first preferred embodiment of the present invention.

Referring to FIG. 1, a light source module 20, in accordance with a present embodiment of the invention, comprises a plurality of light emitting diodes (LED) 21, a heat dissipation device 27 and a thermoelectric cooler 24. The LEDs 21 can be white LEDs or multicolor LEDs such as red, green and blue LEDs. The thermoelectric cooler 24 comprises a cold side 241 and a hot side 242 on an opposite side thereof. The LEDs 21 thermally contact with the cold side 241 of the thermoelectric cooler 24, and the heat dissipation device 27 thermally contacts with the hot side 242 of the thermoelectric cooler 24. The heat generated by the LEDs 21 can be transmitted through the thermoelectric cooler 24 to the heat dissipation device 27. An outer surface of the thermoelectric cooler 24 is made of insulative material that has low heat conductivity. Thus, the outer surface of the hot side 242 is covered by a metal layer 22 with high heat conductivity. The metal layer 22 is sandwiched between the hot side 242 and the heat dissipation device 27 for enhancing heat dissipation efficiency of the thermoelectric cooler 24.

The heat dissipation device 27 comprises a base 271 and a plurality of fins 272 extending upwardly from the base 271. The base 271 is coupled on the metal layer 22, and thermally contacts with the hot side 242 of the thermoelectric cooler 24 through the metal layer 22.

The LEDs 21 are mounted on a printed circuit board 23, through which the LEDs 21 thermally contact with the cold side 241 of the thermoelectric cooler 24. The printed circuit board 23 can be made of metal, ceramic or fiberglass.

Heat is generated from the LEDs 21 during illumination. When the temperature of the light source module 20 rises beyond the normal temperature range, the heat generated by the LEDs 21 can be absorbed by the thermoelectric cooler 24 in an electric energy manner and then forcedly transferred to the hot side 242 from the cold side 241 of the thermoelectric cooler 24. The heat accumulated on the hot side 242 of the thermoelectric cooler 24 can be immediately dissipated via the fins 272 of the heat dissipation device 27 where the heat is dissipated to atmosphere. The heat flux from the LEDs 21 to the cold side 241 of the thermoelectric cooler 24, and the heat flux from the hot side 242 of the thermoelectric cooler 24 to the fins 272 of the heat dissipation device 27 are respectively more than the heat flux from the LEDs 21 directly to the fins 272 when the thermoelectric cooler 24 is not mounted between the LEDs 21 and the heat dissipation device 27. Thus, by the provision of the thermoelectric cooler 24 mounted between the LEDs 21 and the heat dissipation device 27, the efficiency of the heat dissipation of the LEDs 21 can be improved, and therefore the light source module 20 could operates at a normal temperature range so as to achieve a better optical performance.

Figure 2:
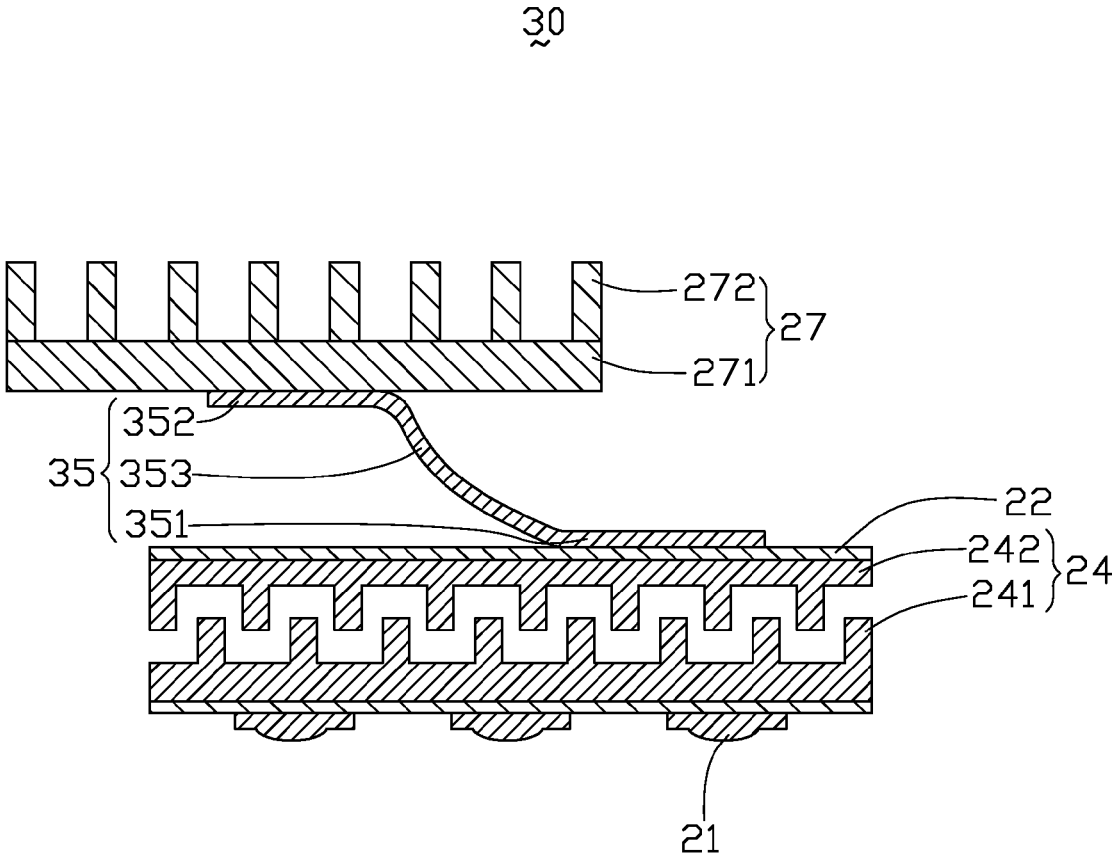
FIG. 2 is a cross-sectional view of a light source module, in accordance with a second embodiment of the present invention.

Referring to FIG. 2, a light source module 30, in accordance with a second embodiment of the present invention, is provided. Compared with the first embodiment, the light source module 30 further comprises a heat conducting element 35 disposed between the thermoelectric cooler 24 and the heat dissipation device 27. The heat conducting element 35 comprises two ends 351,352, and a bending portion 353 located between and connected with the two ends 351,352. Specifically, the end 351 is coupled to the metal layer 22 of the thermoelectric cooler 24, and the other end 352 is coupled to the base 271 of the heat dissipation device 27. The heat from the hot side 242 of the thermoelectric cooler 24 can be transferred to the heat dissipation device 27 by the heat conducting element 35. Thus, the position of the heat dissipation device 27 will not be restrained by the LEDs 21 and the thermoelectric cooler 24. The contact areas between the heat conducting element 35 and the metal layer 22, the base 271 should be as large as possible to enhance the heat dissipation efficiency of the light source module 30. The heat conducting element 35 is advantageously made of flexible material with high heat conductivity. The heat conducting element 35 can also be rigid such as a heat pipe, and can be a sheet-like or pipe-like shape.

Figure 3:
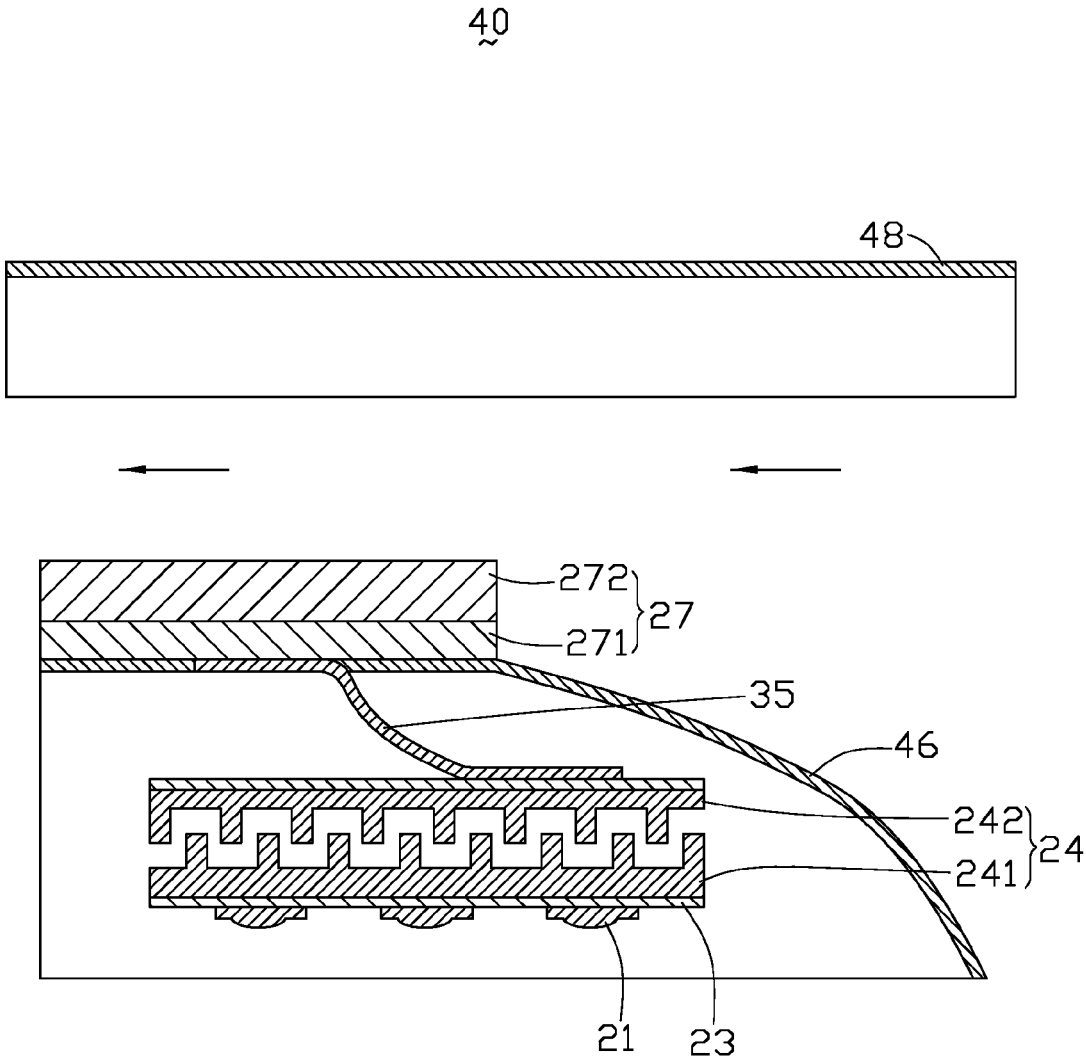
FIG. 3 is a cross-sectional view of a light source module, in accordance with a third embodiment of the present invention.
Figure 4:
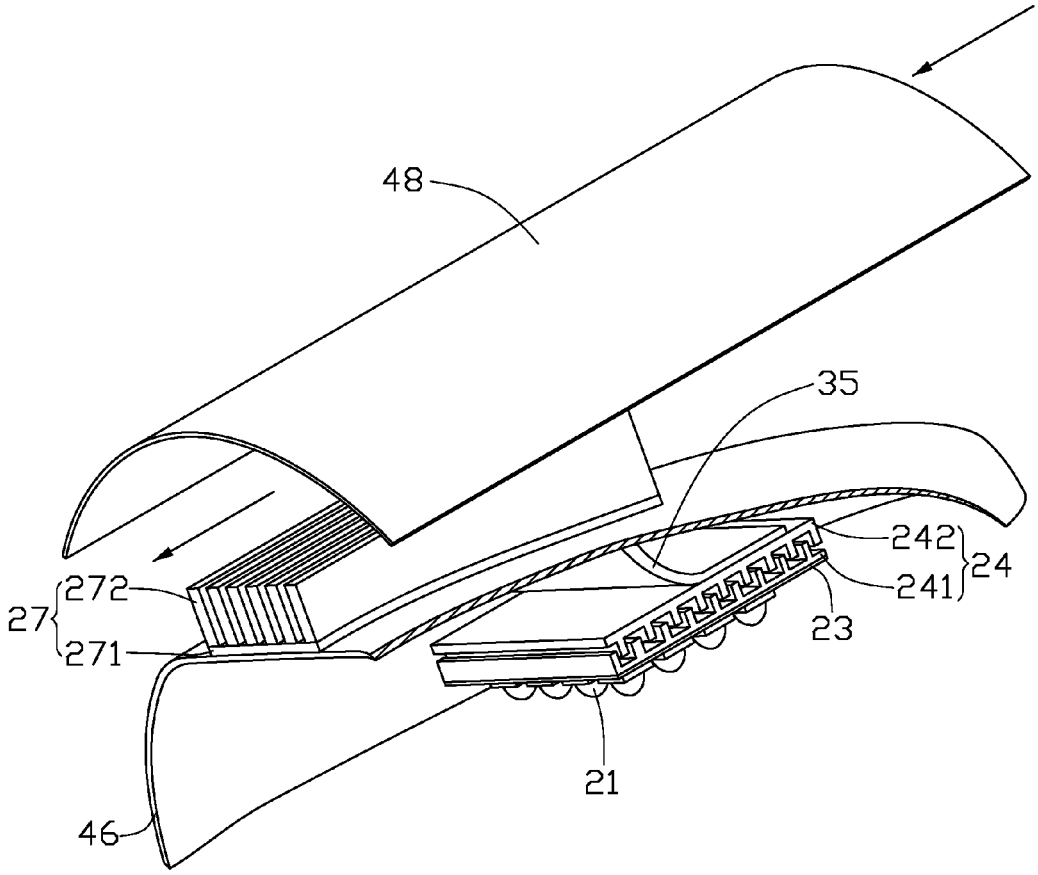
FIG. 4 is a cut away view of the light source module of FIG. 3.
Figure 5:
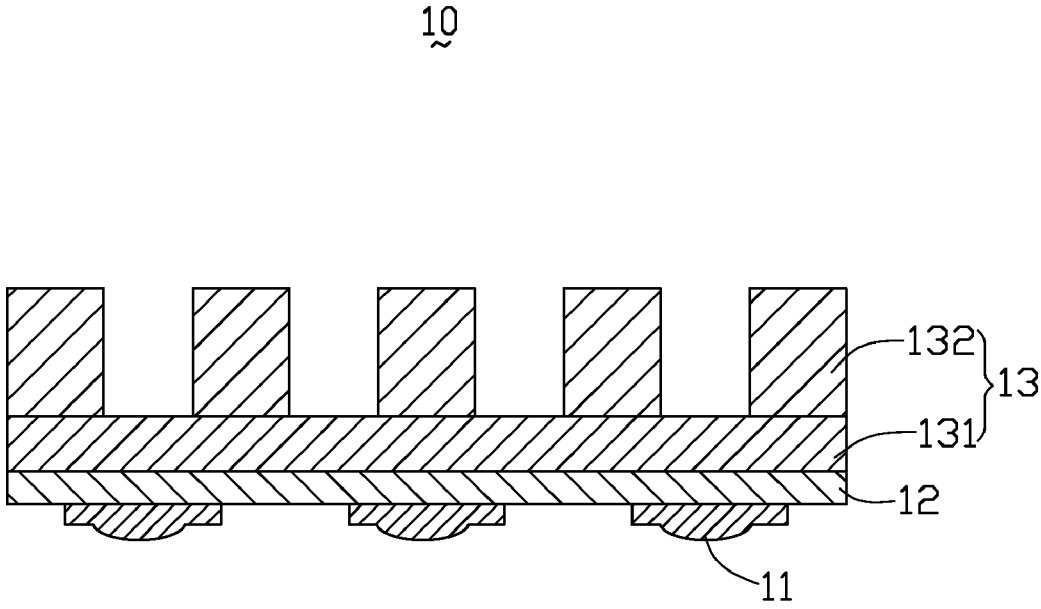
FIG. 5 (RELATED ART)
FIG. 5 is a side sectional view of a related light source module.

FIGS. 3-4 show a third embodiment of a light source module 40 according to the present invention. Compared with the second embodiment, the light source module further comprises a housing 46 and a masking blade 48. The LEDs 21, the thermoelectric cooler 24 and the printed circuit board 23 are received in the housing 46. The housing 46 serves as a protective component to the LEDs 21, the thermoelectric cooler 24 and the printed circuit board 23. The heat conducting element 35 extends through a top portion of the housing 46 to thermally contact with the base 271 of the heat dissipation device 27.

The masking blade 48 is located above the heat dissipation device 27 opposite to the housing 46. The masking blade 48 forms an arc-shaped configuration with a concave surface (not labeled) facing toward the heat dissipation device 27. A channel (not labeled) is defined between the heat dissipation device 27 and the masking blade 48. Thus, an airflow can flow through the channel in a direction shown as arrows for increasing the heat dissipation efficiency of the heat dissipation device 27. The masking blade 48 can also serve as a light-shield when the light source module 40 is used outdoors, so as to avoid the LEDs 21 from being exposed under the sun that could accelerate an aging process of the LEDs 21. Therefore, the lifespan of the light source module 40 is prolonged.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A light source module, comprising:

a plurality of light emitting diodes;

a heat dissipation device;

a thermoelectric cooler having a cold side and a hot side, the cold side thermally contacting with the light emitting diodes, and the hot side thermally contacting with the heat dissipation device; and a heat conducting element comprising two distal ends and a bending portion interconnected between the two distal ends, wherein the two distal ends of the heat conducting element thermally contact with the hot side of the thermoelectric cooler and the heat dissipation device, respectively.

2. The light source module as claimed in claim 1, wherein the heat conducting element is a heat pipe.

3. The light source module as claimed in claim 1, wherein the heat conducting element is made of flexible material with high heat conductivity.

4. The light source module as claimed in claim 1, further comprising a printed circuit board for securing the light emitting diodes thereon, wherein the light emitting diodes thermally contact with the cold side of the thermoelectric cooler via the printed circuit board.

5. The light source module as claimed in claim 4, further comprising a housing for receiving the light emitting diodes, the thermoelectric cooler and the printed circuit board therein, the heat conducting element extending through the housing to thermally contact with the heat dissipation device.

6. The light source module as claimed in claim 5, further comprising a masking blade located on an opposite side of the heat dissipation device to the housing for preventing sunlight from irradiating the light source module.

7. The light source module as claimed in claim 6, wherein the masking blade has an arc-shaped surface facing toward the heat dissipation device.

8. The light source module as claimed in claim 1, wherein the light emitting diodes comprise at least one white light emitting diode.

9. The light source module as claimed in claim 1, wherein the heat dissipation device comprises a base thermally contacting with the hot side of the thermoelectric cooler and a plurality of fins extending from the base along a direction away from the hot side and substantially perpendicular to the base.

10. The light source module as claimed in claim 1, further comprising a metal layer, the metal layer sandwiched between the heat dissipation device and the hot side of the thermoelectric cooler, and covering the hot side of the thermoelectric cooler.

* * * * *